US006000997A

United States Patent [19]

Kao et al.

[11] Patent Number: 6,000,997

[45] Date of Patent: Dec. 14, 1999

[54] TEMPERATURE REGULATION IN A CMP PROCESS

[75] Inventors: Shu-Hsin Kao, Redwood City; Shou-sung Chang, Sunnyvale; Huey M. Tzeng, San Jose; Gregory C. Lee, Sunnyvale; Greg Simon, Redwood City; Harry Lee, Los Altos; David E. Weldon, Santa Clara; Garry Kwong, San Jose; William F. Lapson, Cupertino; Gregory A. Appel; Peter Mok, both of San Francisco, all of Calif.

[73] Assignee: Aplex, Inc., Sunnyvale, Calif.

[21] Appl. No.: 09/113,450

[22] Filed: Jul. 10, 1998

[51] Int. Cl.[6] ..... B24B 49/14

[52] U.S. Cl. ..... 451/7; 451/53

[58] Field of Search ..... 451/296, 307, 451/303, 53, 7

[56] References Cited

U.S. PATENT DOCUMENTS 5,558,568 9/1996 Talieh et al. ..... 451/303
5,593,344 1/1997 Weldon et al. ..... 451/296
5,607,341 3/1997 Leach ..... 451/41
5,692,947 12/1997 Talieh et al. ..... 451/41
5,762,536 6/1998 Pant et al. ..... 451/6

*Primary Examiner*—Joseph J. Hail, III
*Assistant Examiner*—William Hong
*Attorney, Agent, or Firm*—Skjerven, Morrill, MacPherson, Franklin & Friel LLP; Edward C. Kwok

[57] ABSTRACT

Heat is transferred between a linear CMP belt and an adjacent heat transfer source, providing a predetermined lateral temperature distribution across the belt. Temperature sensors generate feedback signals to control the heat transfer sources. Alternatively, process monitoring sensors provide feedback signals. The heat transfer source can include multiple selectively controllable individual heat transfer sources having differing temperatures, which can be above or below ambient temperature. The mechanism of heat transfer can include one or more of convection, conduction, and radiation. The configuration provides substantial flexibility to establish and maintain selective non-uniform temperature distributions across the polishing belt. This in turn permits precise control and stability of the polishing process. Heat transfer sources can include pulleys, slurry dispensers, polishing pad conditioners or conditioner back supports, fluid nozzles, and sealed fluid cavity belt supports.

32 Claims, 6 Drawing Sheets

TEMPERATURE REGULATION IN A CMP PROCESS

FIELD OF THE INVENTION

The present invention relates to semiconductor wafer polishing, including chemical-mechanical polishing (CMP). In particular, the present invention relates to temperature regulation in a CMP process.

BACKGROUND

In sub-micron scale integrated circuits, CMP techniques are used to create the planarity required in multi-level interconnect structures. Specifically, to create a planar surface for depositing an interconnect layer, e.g. aluminum, tungsten, or copper, an interlayer dielectric (e.g., silicon dioxide) is planarized by a polishing process. This polishing process uses a polishing pad, usually polyurethane, under pressure in frictional contact with the wafer surface. The polishing pad carries an alkaline or acidic slurry with a fine abrasive.

CMP in semiconductor processing removes the highest points from the surface of a wafer to polish the surface, as described for example in Leach, U.S. Pat. No. 5,607,341, issued Mar. 4, 1997. CMP operations are performed on unprocessed and partially processed wafers. A typical unprocessed wafer is crystalline silicon or another semiconductor material that is formed into a nearly circular flat wafer. A typical wafer, when ready for polishing, has a top layer of a dielectric material such as glass, silicon dioxide, or of a metal conformally overlying one or more patterned layers. These underlying patterned layers create local protrusions on the order of about 1 $\mu$m in height on the dielectric surface of the wafer. Polishing smoothes the local features, so that ideally the surface of the wafer is flat or planarized over an area the size of a die (a potential semiconductor chip) formed on the wafer. Currently, polishing is sought that locally planarizes the wafer to a tolerance of about 0.3 $\mu$m over the area of a die about 10 mm by 10 mm in size.

To maintain uniformity over the polished surface of the interlayer dielectric and to provide wafer-to-wafer reproducibility (global uniformity) of the polishing process, the polishing surface, typically a polyurethane pad, is required to be conditioned during use or between uses.

Polishing rate and uniformity depend in a complex fashion on a number of process variables at the wafer-pad interface, significantly contact pressure, relative velocity between the polishing pad and wafer surface, hardness (durometer) of the polishing pad, properties of the slurry, and rate of chemical reaction. Many of these variables are temperature dependent, particularly the chemical reaction rate, although the polishing pad durometer and slurry viscosity, for example, are also temperature dependent.

Because of the temperature dependence of process variables in CMP, it is desired to regulate the temperature in order to stabilize these process variables. It is additionally desired to provide precise control of temperature over the range of interest, i.e., a range of about 40 degrees F. to 120 degrees F. (about 4° C. to about 50° C.). It is ultimately desired to provide a controlled distribution of temperature locally across a wafer surface and from wafer-to-wafer.

Traditionally, CMP is performed using a planetary CMP apparatus. FIG. 1 is a schematic plan view of a planetary CMP apparatus 100. As shown in FIG. 1, CMP apparatus 100 includes a polishing table or platen 103, rotating in the direction indicated by reference numeral 105. Onto platen 103 is mounted a polishing pad 104. A silicon wafer (not shown) is mounted onto a polishing head 101 and is pressed against the surface of polishing pad 104. Polishing head 101 rotates the silicon wafer in a direction 109, generally in the same direction 105 of rotating platen 103. In addition, an oscillating arm 106 reciprocates polishing head 101 laterally along an arc indicated by reference numerals 108*a* and 108*b*. Correspondingly, a conditioning pad (not shown) is mounted onto a smaller platen 102 against polishing pad 104. Platen 102 rotates in the direction indicated by reference numeral 110 and is reciprocated by an oscillating arm 111 along an arc indicated by reference numerals 107*a* and 107*b* throughout the CMP process. Slurry is sprayed or otherwise applied onto the surface of polishing pad 104 by a slurry dispenser 113 throughout the CMP process.

Temperature regulation is difficult to achieve in the traditional planetary CMP configuration of FIG. 1. Non-uniform heating is produced by friction at the wafer-pad interface, due to the locally variable and complex motion of the polishing pad relative to the wafer surface. Temperature stabilization has been attempted by passing temperature controlled water or other heat transfer fluid through passages (not shown) internal to platen 103. Fluid temperatures have typically ranged from about 4° C. to about 50° C. Internal fluid cooling requires complicated rotary fluid feedthroughs. Additionally, platen 103 has a large thermal mass, and therefore causes substantial thermal hysteresis. Further, it is difficult to transfer heat between rotating platen 103 and the wafer-pad interface with a distribution that offsets the frictional heating profile.

Temperature stabilization of a CMP process has also been attempted by cooling or heating the slurry prior to dispensing by slurry dispenser 113. As with platen temperature stabilization, the result has been at best to bias the average process temperature lower or higher. This temperature bias can increase or decrease the removal rate globally, but cannot offset the complex local non-uniform temperature profile generated by frictional heating at the wafer-pad interface.

Thus, attempts at temperature regulation in a traditional planetary CMP process have produced unsatisfactory results. What is needed in the art is an apparatus and method to regulate the temperature in order to stabilize a CMP process. Additionally needed are an apparatus and method to provide precise control of temperature in a CMP process over the temperature range of interest, typically a range of about 4° C. to 50° C. Ultimately needed in the art are an apparatus and method to provide a controlled local temperature distribution across a wafer surface and from wafer-to-wafer in a CMP process. The above needs should be fulfilled without incurring excessive cost, complexity, or detrimental side effects such as thermal stresses.

SUMMARY

An apparatus and method of controlling the polishing rate of an object in a belt polishing apparatus are described. A controllable heat transfer source is disposed proximate to a surface of the belt. Heat is transferred between the belt and/or pad and the heat transfer source in response to control signals, providing a predetermined lateral temperature distribution across the belt. In some embodiments temperature sensors measure the temperature distribution and generate feedback signals to a control mechanism for the heat transfer sources. In some embodiments process monitoring sensors generate feedback signals to the control mechanism.

The heat transfer source can include multiple selectively controllable individual heat transfer sources. The temperature of each individual heat transfer source can be individually controlled or set. A heat transfer source can have a temperature above or below a set point, e.g., ambient temperature. The mechanism of heat transfer can include fluid convection, solid conduction, radiation, or a combination of the three methods. The embodiments of the invention provide substantial flexibility to establish and maintain selective non-uniform temperature distributions across the polishing belt. This in turn permits precise control and stability of the polishing process.

Some heat transfer sources are incorporated with other existing portions of the polishing apparatus, including a pulley, a slurry dispenser, a polishing pad conditioner or conditioner back support. Other heat transfer sources include fluid nozzles. Some heat transfer sources are incorporated into a sealed fluid cavity support for the belt. Some versions of the sealed fluid cavity support include a cavity seal, e.g., a labyrinth seal.

The present invention is better understood upon consideration of the detailed description below, in conjunction with the accompanying drawings.

BRIEF DESCRIPTION OF THE DRAWINGS

The present invention may be better understood, and its numerous objects, features, and advantages made apparent to those skilled in the art by referencing the accompanying drawings. For simplicity and ease of understanding, common numbering of elements within the illustrations is employed where an element is the same in different drawings.

DETAILED DESCRIPTION OF THE EMBODIMENTS

The following is a detailed description of illustrative embodiments of the present invention. As these embodiments of the present invention are described with reference to the aforementioned drawings, various modifications or adaptations of the methods and or specific structures described may become apparent. These descriptions and drawings are not to be considered in a limiting sense as it is understood that the present invention is in no way limited to the embodiments illustrated.

Figure 2A:
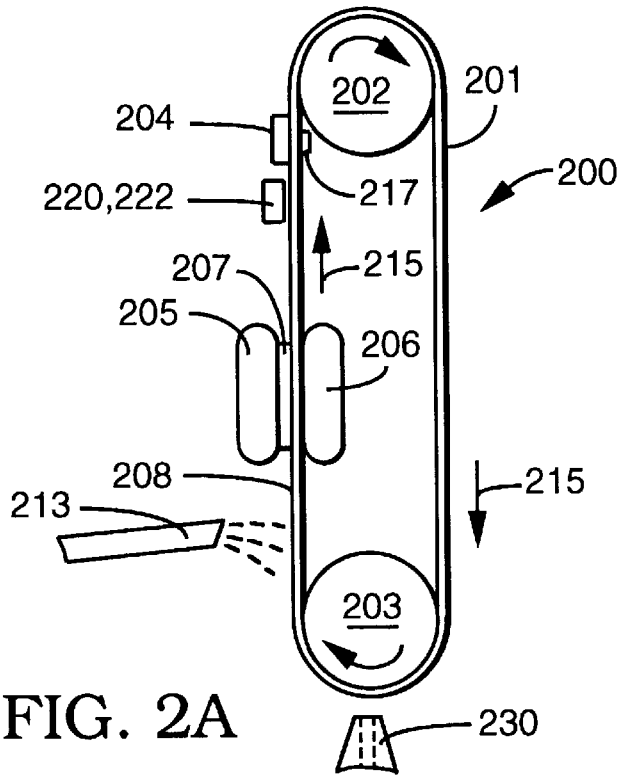
FIGS. 2*a* and 2*b* are side and front views, respectively, of a linear CMP apparatus, in accordance with an embodiment of the present invention.
Figure 2B:
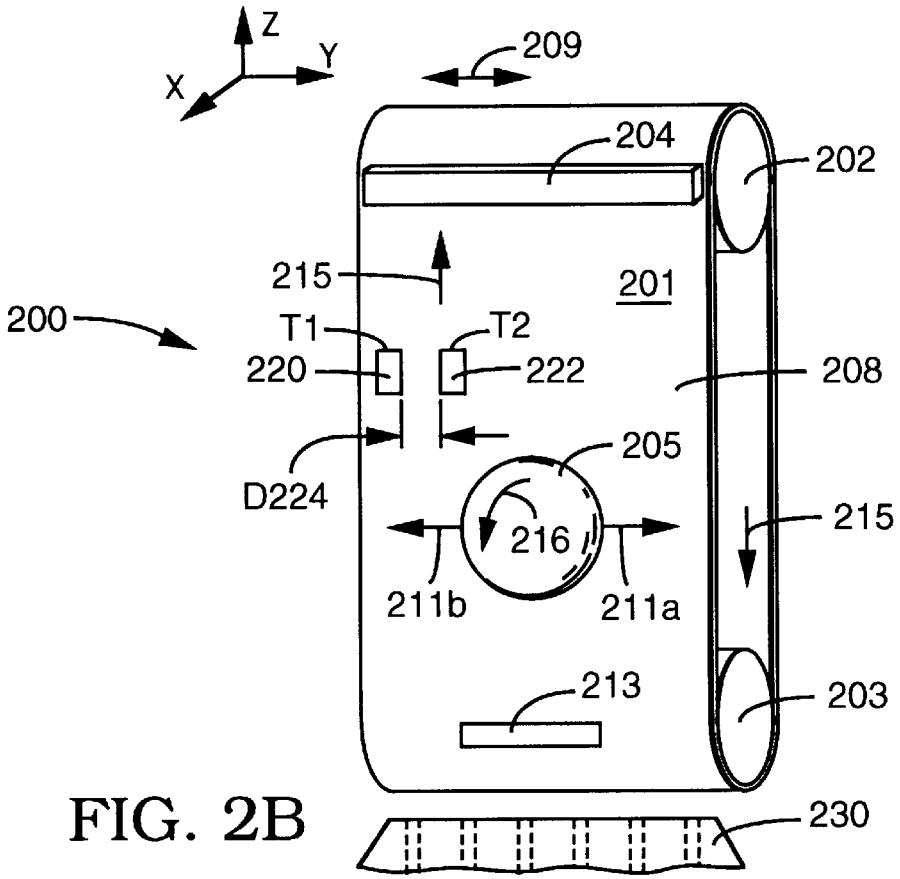

The present invention relates to an apparatus and method for temperature regulation in a CMP process, particularly relating to a linear CMP configuration. FIGS. 2*a* and 2*b* are side and front views, respectively, of a linear CMP apparatus 200. Linear CMP apparatus is disclosed in Anderson et al., "Modular Wafer Polishing Apparatus and Method," U.S. application Ser. No. 08/964,930, filed Nov. 5, 1997, copending herewith and assigned to Aplex Inc., which is also the Assignee of the present application, the disclosure of which is incorporated herein by reference in its entirety.

As shown in FIGS. 2*a* and 2*b,* linear CMP apparatus 200 includes a continuous polishing belt 201 configured to polish one or more vertically supported semiconductor wafers, such as a wafer 207. Wafer 207 is held vertically (parallel to the z-axis, as shown by the coordinate axes in FIG. 2*b*) by a polishing head 205, which presses wafer 207 longitudinally (parallel to the x-axis) against a polishing pad 208 attached to vertically mounted polishing belt 201. Polishing belt 201 is kept in continuous motion at a selected polishing speed within a range of approximately 0–600 feet per minute or 0–3 meters per second by rotating pulleys 202 and 203. A center support 206 provides an opposing force to press wafer 207 at a preselected pressure within a range of approximately 1–10 PSI or 6–70 kPa against polishing pad 208. Polishing head 205 rotates at approximately 5 rpm to approximately 75 rpm in a predetermined direction indicated by reference numeral 216. Polishing head 205 is reciprocated laterally (parallel to the y-axis) at approximately 0–20 inches per minute (0–500 mm per minute) by an oscillating mechanism (not shown) across the surface of polishing pad 208 along a path indicated by reference numerals 211*a* and 211*b*. Thus the combined motions of polishing belt 201, polishing head 205, and an oscillating mechanism cooperatively provide linear polishing for the surface of wafer 207.

In linear CMP processing of a wafer having sub-micron scale interlayer protrusions, it is advantageous to use low contact pressure, high belt speed, and a hard polishing pad material.

While FIGS. 2*a*–2*b* show only one side of the polishing belt assembly being used for wafer polishing, polishing heads 205 can be positioned on both sides of the polishing belt assembly of CMP apparatus 200 relative to a plane of mirror symmetry containing the axes of pulleys 202, 203, thereby effectively doubling the total wafer throughput. A slurry dispenser 213 is mounted adjacent to polishing belt 201, to apply slurry to polishing pad 208. A linear pad conditioning assembly 204 is mounted adjacent polishing belt 201, to provide conditioning for polishing pad 208. Linear pad conditioning assembly 204 includes a linear motion mechanism that allows a conditioning surface to travel laterally in contact with polishing pad 208.

Similar to center support 206, a conditioner back support 217 typically provides an opposing force to support conditioning assembly 204 where a conditioning head (not shown) is pressed against polishing pad 208 at a preselected pressure within a range of approximately 1 PSI to 30 PSI or approximately 6 kPa to 210 kPa, against polishing pad 208. The combined motions of the linear motion mechanism and polishing belt 201 accomplish linear conditioning of polishing pad 208. When polishing heads 205 are provided on both sides of polishing belt assembly 100, a linear pad conditioning assembly 204 can be provided on each side of polishing belt 201.

Figure 1:
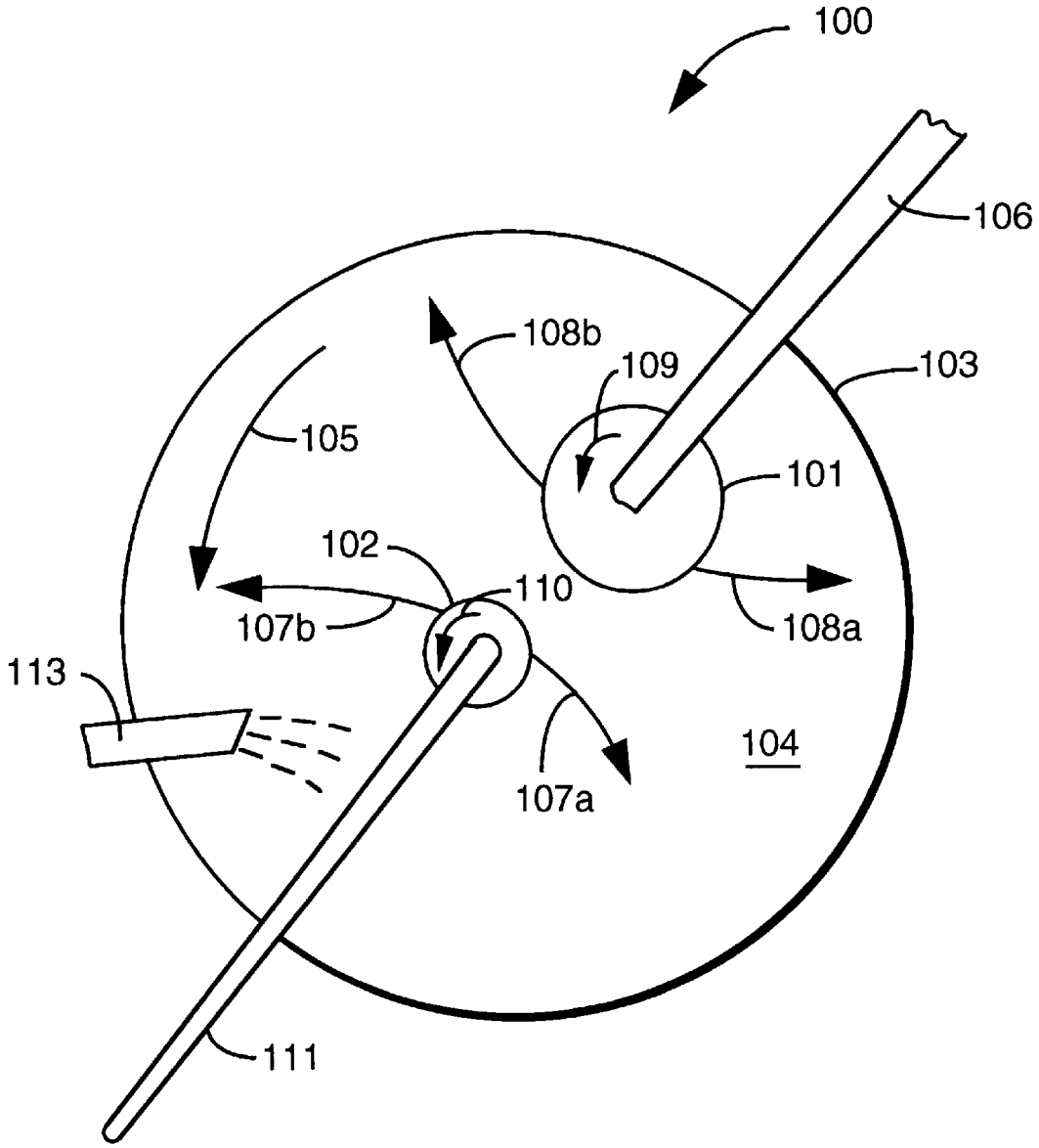
FIG. 1 (PRIOR ART)
FIG. 1 is a schematic plan view of a planetary CMP apparatus, in accordance with prior art.

Unlike massive polishing platen 103, described in connection with planetary CMP apparatus 100 of FIG. 1, polishing belt 201 of linear CMP apparatus 200 is typically a sheet of stainless steel having a thickness of the order of approximately 0.020 inch or approximately 0.5 mm. Thus polishing belt 201 has substantially lower thermal mass and more rapid response to changes in temperature than does platen 103.

Additionally, because of geometry, heat transfers quickly through the thickness of belt 201, whereas lateral heat transfer parallel to the plane of belt 201 occurs more slowly. This facilitates the generation and preservation of non-uniform lateral temperature distributions for a local area and/or across belt 201.

For a belt polisher as described in this patent application without any temperature control mechanism, the pad temperature distribution across the wafer surface is highest at the center and lowest at the edge due to heat generation from friction. This usually contributes to a high polishing rate at the center of the wafer. For embodiments described in this application, it is intended to maintain a uniform temperature distribution across the wafer/pad interface or to specify a non-uniform temperature distribution. Heat generation due to friction during polishing process is therefore controlled to provide a desired CMP process.

FIGS. 2*a* and 2*b* show two heat transfer sources 220 and 222 positioned adjacent to polishing belt 201 and having respective temperatures of T1 and T2. Heat transfer sources 220 and 222 are separated laterally by a distance D224, and are configured to transfer heat longitudinally (parallel to x-direction) into moving polishing belt 201. Since polishing belt 201 is thin longitudinally, heat is transferred rapidly from heat transfer sources 220 and 222 into respective underlying strips of polishing belt 201 aligned vertically (parallel to the belt travel direction) and separated laterally from one another by distance D224. This heat transfer establishes a lateral temperature distribution across the width of polishing belt 201. Such a lateral temperature distribution travels with moving polishing belt 201. Since the belt travel velocity is typically fast, and lateral heat conduction occurs relatively slowly, the lateral temperature distribution established at heat transfer sources 220 and 222 persists on polishing belt 201 with minimal change throughout a complete cycle of belt travel.

A linear CMP configuration therefore provides greater flexibility for temperature regulation relative to a planetary CMP configuration. Heat transfer sources 220 and 222 also can be cooling sources to establish a lateral temperature distribution below ambient temperature.

By monitoring pad temperature during polishing process, multiple transfer sources, e.g., 220 and 222, can be applied to control the pad temperature distribution.

Figure 3A:
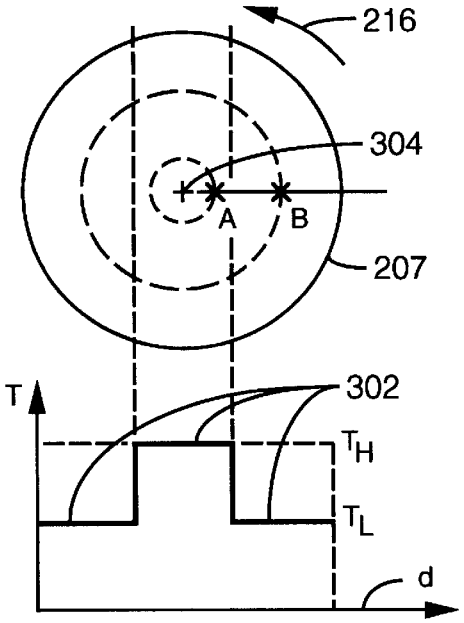
FIG. 3*a* is a graphical representation of a lateral temperature profile across a polishing belt, aligned laterally with a wafer surface having points A and B located at differing radial distances from the wafer center of rotation.

A non-uniform temperature distribution across belt 201 introduces different polishing rates between different portions of a wafer surface, as it rotates during the CMP process. FIG. 3*a* is a graphical representation of a lateral temperature profile 302 that varies with distance d across polishing belt 201. The central portion of temperature profile 302 is at a higher temperature TH than the outer portions at a lower temperature TL. The upper portion of FIG. 3*a* shows a plan view of wafer 207 aligned laterally with polishing belt 201. Wafer 207 rotates in a wafer holder (not shown) in a direction designated by reference numeral 216. Two points A and B, on the surface of wafer 207, are located at differing radial distances from the center of rotation 304 of wafer 207.

Figure 3B:
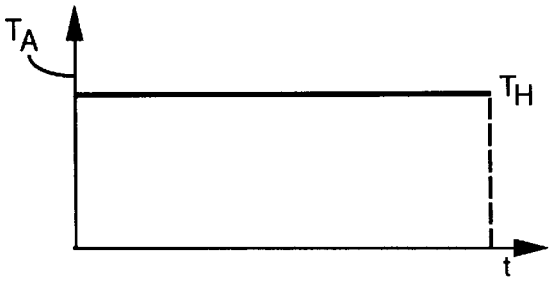
FIGS. 3*b* and 3*c* are graphical representations of temperature-time histories of points A and B respectively during a rotation cycle of a wafer.
Figure 3C:
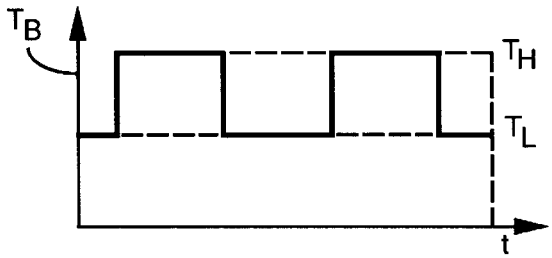

FIGS. 3*b* and 3*c* are graphical representations of temperature-time histories of points A and B respectively during a rotation cycle of wafer 207. Point A rotates entirely across a portion of belt 201 having temperature TH. Therefore, as shown in FIG. 3*b*, point A experiences a constant temperature TA having a value TH during a rotation cycle of wafer 207. As shown in FIG. 3*c*, during a rotation cycle point B moves sequentially across portions of belt 201 having temperatures of TH and TL, and therefore experiences an approximate square-wave temperature history TB between temperatures TL and TH.

Figure 4:
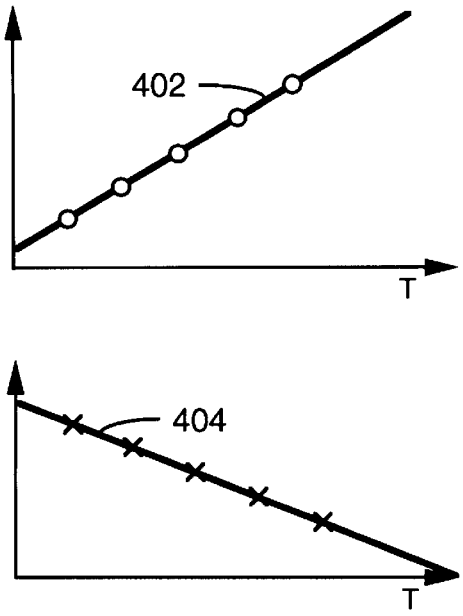
FIG. 4 is a graphical representation of removal rate as an increasing/decreasing function of temperature.

For a particular polishing process, removal rate can be an increasing or decreasing function of temperature, as shown in FIG. 4. The upper portion of FIG. 4 is a graphical representation 402 of removal rate as an increasing function of temperature. The lower portion of FIG. 4 is a graphical representation 404 of removal rate as a decreasing function of temperature. In general, removal rate is a complex, nonlinear function of temperature, and the graphical representations of FIG. 4 have been simplified for clearer understanding of the applicable principles.

Figure 5:
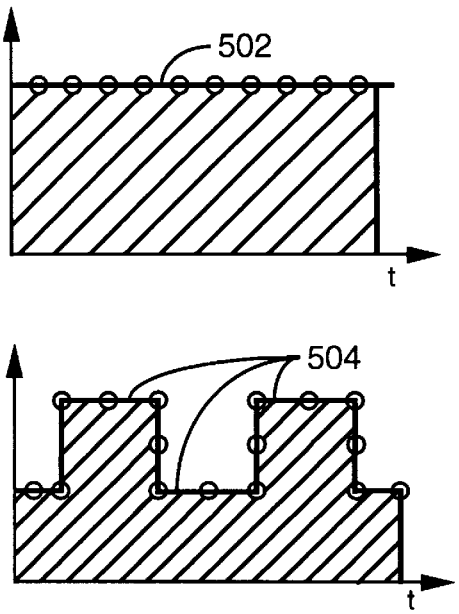
FIG. 5 is a graphical representation of the respective removal rates at points A and B of FIGS. 3*a*–3*c;*

Removal rates at points A and B are therefore typically not equal. FIG. 5 is a graphical representation of the respective removal rates 502 and 504 at points A and B during a rotation cycle of wafer 207, for the case of increasing removal rate with temperature (graphical representation 402 of FIG. 4). Removal rate 502 at point A is constant, since temperature TA (see FIG. 3*b*) is constant over the wafer rotation cycle. Removal rate 504 at point B is variable, with a higher rate occurring at temperature TB of TH and with a lower rate occurring at temperature TB of TL. Those having ordinary skill in the art will recognize that the above described principles can be applied to control a detailed polishing rate profile across a wafer surface by creating a specific lateral temperature distribution across a polishing belt.

A variety of heat sources are inherently associated with linear CMP processing. Non-uniform heating produced by friction at the interface between wafer 207 and polishing pad 208, described in connection with planetary CMP (see FIG. 1), occurs also in linear CMP. Heat is also generated at the interface between wafer 207 and polishing pad 208 by exothermic chemical reactions involving the slurry (not shown). Frictional heat is generated at the respective interfaces between conditioner 204 and polishing pad 208, between center support 206 and polishing belt 201, and between conditioner back support 217 and polishing belt 201. Additionally, frictional heat is generated by flexing and slippage at the interface between polishing belt 201 and pulleys 202, 203, or is transferred to polishing belt 201 from pulley bearings (not shown).

Of importance, the above heat sources should be considered carefully in connection with the implementation of embodiments of the present invention. Those having ordinary skill in the art will recognize that global approaches to temperature regulation and stabilization, e.g. overall temperature control of the process chamber, are inherently incapable of compensating for non-uniform local heating sources.

Figure 6A:
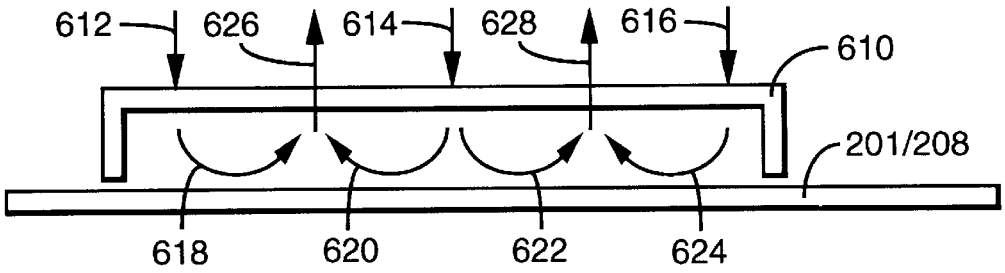
FIGS. 6*a*–6*c* are schematic views illustrating various methods of providing a persistent non-uniform lateral temperature distribution across a moving polishing belt, in accordance with an embodiment of the present invention.
Figure 6B:
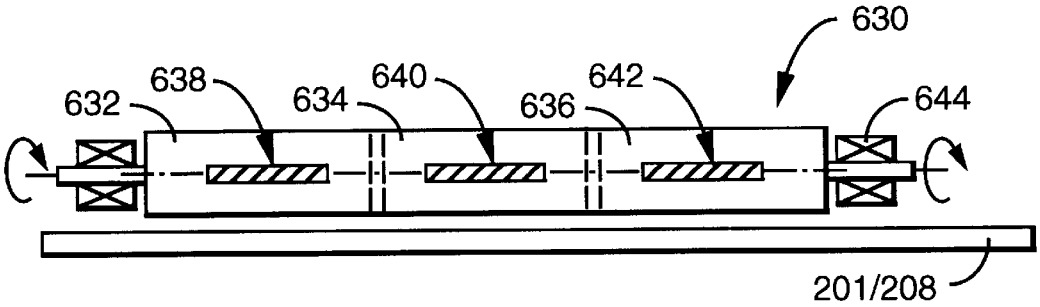
Figure 6C:
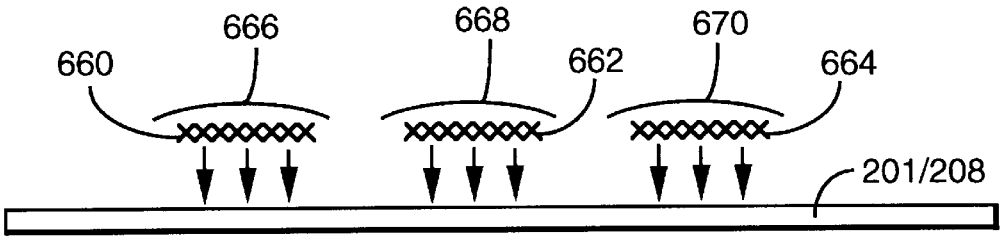

FIGS. 6*a*–6*c* are schematic views illustrating various methods of providing a persistent non-uniform lateral temperature distribution across moving polishing belt 201 and/or polishing pad 208, as described above in connection with FIGS. 2*a*–5. FIG. 6*a* is a cross-sectional view showing an example of heat transfer by fluid convection. FIG. 6*b* is a cross-sectional view showing an example of heat transfer by solid conduction. FIG. 6*c* is a cross-sectional view showing an example of heat transfer by radiation.

Referring to FIG. 6*a,* a plenum 610 with an open side is located in close proximity to polishing belt 201 and/or polishing pad 208, such that polishing belt 201 and/or polishing pad 208 effectively provides the missing side of plenum 610. The belt travel direction in FIGS. 6*a*–6*c* is perpendicular to the plane of the figure.

Temperature controlled fluid enters plenum 610 through inlet ports, e.g. ports 612, 614, and 616, providing fluid streams 618, 620, 622, and 624, which contact and transfer heat locally by convection to polishing belt 201 and/or polishing pad 208. The fluid contacting polishing belt 201 can be either liquid, e.g. water, or gas, e.g. air, or mist which is preheated and/or precooled remote from plenum 610. The fluid contacting polishing pad 208 can be slurry or other process compatible fluid. The fluid entering through differing inlet ports 612, 614, 616 can be the same temperature or differing temperatures above or below a user specified set point, e.g., ambient temperature, as desired. For example, fluid entering through inlet ports 612 and 616 can be cold, and fluid entering through inlet port 614 can be hot. Exhaust fluid at an intermediate temperature exits plenum 610 through outlet ports 626 and 628 for disposal or recycling. Optional baffles (not shown) can be installed between adjacent sets of inlet and/or outlet ports to provide additional flow and temperature control. The apparatus of FIG. 6*a* provides a non-uniform lateral temperature distribution by fluid convection across polishing belt 201 and/or polishing pad 208.

The lateral temperature distribution can be controlled by selectively changing the temperature of fluid entering through individual inlet ports. Additionally, the lateral temperature distribution can be controlled by varying the number and/or lateral positions of active inlet and/or outlet ports, by selectively varying the fluid flow rates through individual inlet and/or outlet ports, by adjusting baffles, and by combinations of the above methods.

Figure 7:
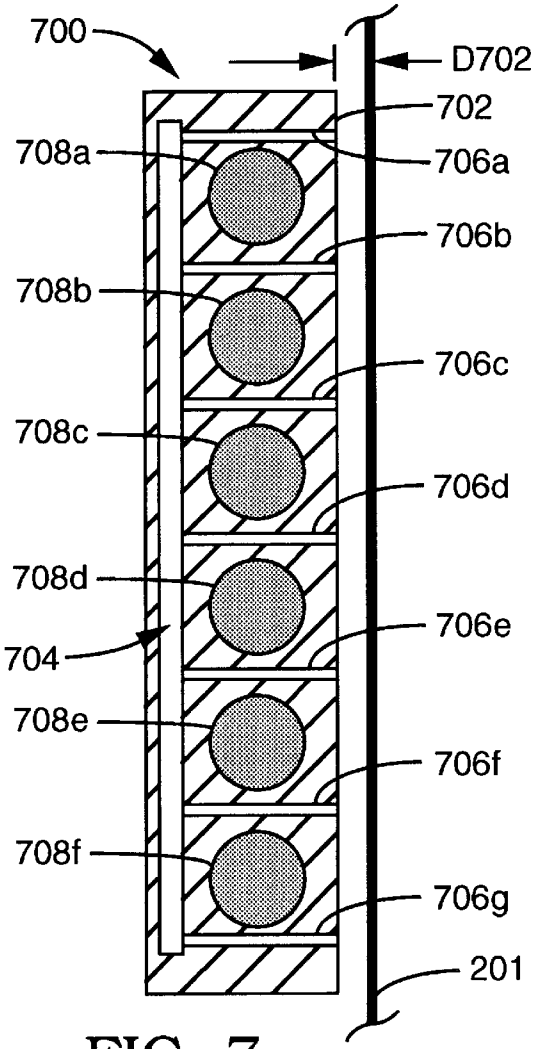
FIG. 7 is a cross-sectional view of a convective heat transfer arrangement, in accordance with an embodiment of the present invention.

FIG. 7 is a cross-sectional view of a convective heat transfer arrangement, in accordance with another embodiment of the invention. A heat transfer block 700 is positioned with a surface 702 parallel and spaced by a width D702 relative to polishing belt 201. Heat transfer block 700 contains an air manifold 704 having air flow channels 706*a*–706*g* extending through heat transfer block 700 from manifold 704 to surface 702. Heat transfer block 700 also contains liquid flow channels 708*a*–708*f* located between consecutive air flow channels 706*a*–706*g*.

Air flows into manifold 704 through an inlet port (not shown) and flows out through air flow channels 706*a*–706*g*. The air flow rate is adjusted to provide a conventional air bearing surface in the space defined by width D702 between polishing belt 201 and surface 702 of heat transfer block 700. Heated or cooled water or other appropriate heat transfer liquid flows through liquid flow channels 708*a*–708*f* and heats or cools air flowing through air flow channels 706*a*–706*g* by heat transfer through heat transfer block 700. Air flowing out through air flow channels 706*a*–706*g* contacts and transfers heat to polishing belt 201. To provide a non-uniform lateral temperature distribution across polishing belt 201, heat transfer block 700 can be partitioned laterally into thermally insulated individual segments, such that the temperature of liquid flowing in each segment is individually selectable. The liquid in each segment then transfers its selected temperature to the air flowing through the air flow channels in the same respective segment.

Other variations of convective heat transfer include a lateral array of fluid nozzles 230 (See FIGS. 2*a,* 2*b*) directed substantially perpendicular onto selected lateral strips of polishing belt 201. The fluid contacting polishing belt 201 can be either liquid, e.g. water, or gas, e.g. air, or mist, which is preheated and/or precooled remote from plenum 610. The fluid contacting polishing pad 208 can be slurry or other process compatible fluid. In one embodiment, selective evaporative cooling is applied by selective spraying of a mist onto the surface of polishing belt 201.

A direct fluid convection heat transfer apparatus, for example as shown in FIG. 6*a,* can be installed as a stand-alone entity at any arbitrary position along the travel of polishing belt 201, and can be located adjacent either polishing belt 201 or polishing pad 208. Alternatively, the fluid convection heat transfer function can be combined with other existing functions, e.g., slurry dispensing.

Slurry dispensers are described in Mok, U.S. patent application Ser. No. 08/965,067, filed Nov. 5, 1997, and Mok et al., U.S. patent application Ser. No. 09/113,727 [Attorney Docket M-4982-1P US], the latter cofiled herewith, the specifications of which are incorporated herein by reference in their entirety, both assigned to Aplex, Inc., the Assignee of the present patent application.

Figure 8:
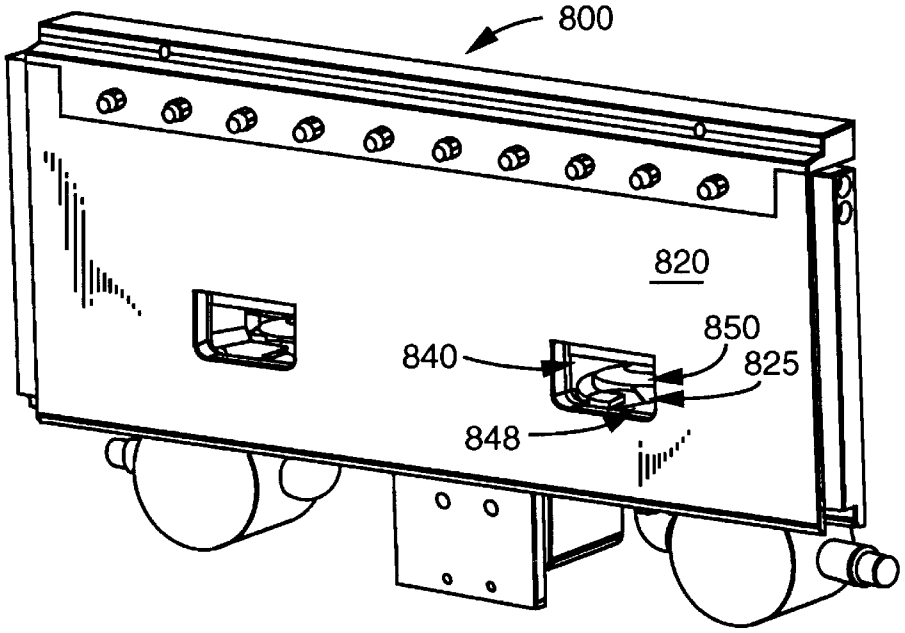
FIG. 8 is an isometric view of a slurry dispenser incorporating convective heat transfer, in accordance with an embodiment of the present invention.

FIG. 8 is an isometric view of a slurry dispenser 800 incorporating convective heat transfer. Fresh slurry is dispensed at a controlled rate onto polishing pad 208 (see FIGS. 2*a,* 2*b*) by slurry dispenser 800, as described in Mok et al. [M-4982-1P US], cited above. As shown in FIG. 8, slurry dispenser 800 includes a front face 820 with openings 825 to a wheel housing 840 positioned behind front face 820. Slurry dispenser 800 is oriented so that front face 820 is turned toward polishing pad 208. The interior of wheel housing 840 contains two wheels 850, positioned above slurry reservoir slots 848 in the bottom face of the wheel housing interior.

During operation, motors (not shown) turn wheels 850 in opposite directions at a predetermined speed (e.g., approximately 1000 revolutions per minute to 3000 revolutions per minute). This provides an overlapping spray of slurry across polishing pad 208. To provide convective heat transfer, the slurry can be heated and cooled at a slurry supply (not shown) or in a slurry supply line (not shown) supplying slurry to slurry dispenser 800. Alternatively, the slurry can be heated or cooled in slurry dispenser 800, by incorporating flow channels (not shown) containing heat transfer liquid, or resistive heating elements (not shown), or thermoelectric cooling elements (not shown) into slurry dispenser 800. Controlled heat transfer is also applicable to other types of slurry dispensers, supplying both heated and cooled slurry.

As a further example, convective heat transfer can be combined with a center support 206 (see FIG. 2*a*), particularly a sealed fluid cavity support. Linear polishing systems with sealed fluid cavity support are described in Weldon et al., U.S. patent application Ser. No. 08/964,773, filed Nov. 5, 1997, and in Kao et al., U.S. patent application Ser. No. 09/113,540 [Attorney Docket No. M-5731 US], cofiled herewith, the specifications of which are incorporated herein by reference in their entirety, both assigned to Aplex, Inc., the Assignee of the present patent application.

Figure 9:
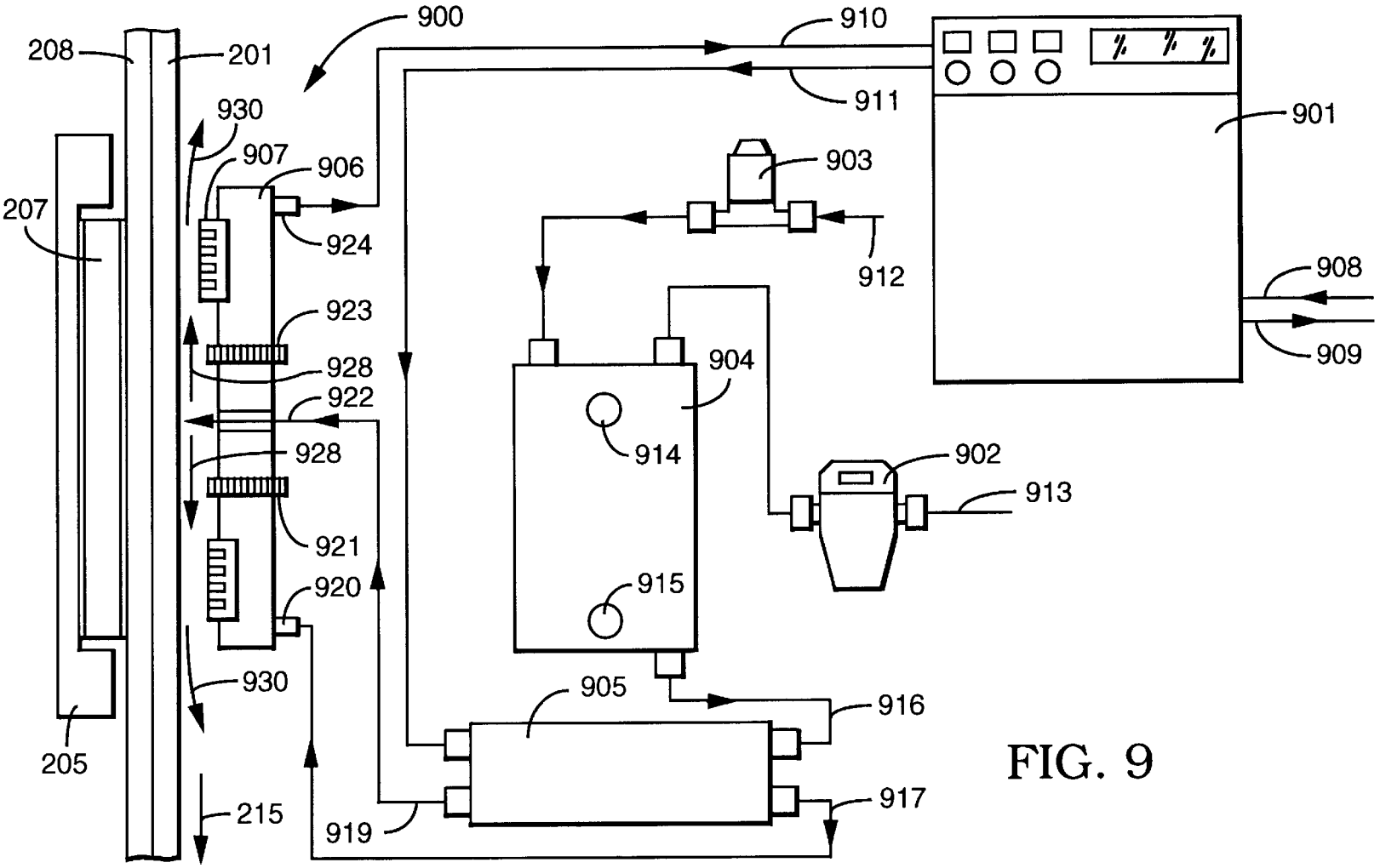
FIG. 9 is a schematic diagram illustrating heat transfer by convection combined with a sealed fluid cavity center support, in accordance with an embodiment of the present invention.

FIG. 9 is a schematic diagram showing an example of heat transfer by convection combined with a sealed fluid cavity center support. Particularly, the configuration of FIG. 9 is applicable to a moving center support in a linear polishing system. Wafer 207 in polishing head 205 is pressed against the working surface of polishing pad 208, which is attached to polishing belt 201, traveling in the direction indicated by reference numeral 215. A sealed fluid cavity center support 900 provides opposing pressure against the opposite surface of polishing belt 201. Center support 900 includes a temperature control unit (TCU) 906 containing a cavity seal 907, e.g. o-ring seal, spring loaded seal, labyrinth seal, or a combination. A labyrinth seal, which can be detachable from TCU 906 or can be integral with TCU 906, is described in Kao et al. [M-5731 US], cited above. As further described in Kao et al. [M-5731 US], cited above, TCU 906 is either a unitary plate or an assembly including individual parts. A cavity 928 is bounded by TCU 906, cavity seal 907, and a portion of polishing belt 201. Cavity seal 907 provides a dynamic fluid seal against the surface of moving polishing belt 201.

A recirculating flow of temperature controlled liquid is provided by a recirculating chiller/heater 901, which is optionally connected with facility recirculating water through facility water inlet 908 and facility water outlet 909. The temperature controlled liquid flows through a liquid supply line 911 to a heat exchanger 905. The temperature controlled liquid then flows from heat exchanger 905 through a TCU liquid supply line 917 to TCU liquid inlet 920. The temperature controlled liquid then flows through internal channels (not shown) in TCU 906 to TCU liquid outlet 924 and then through liquid return line 910 to chiller/heater 901.

Deionized (DI) water or other process compatible fluid is supplied from a DI water tank 904 under air pressure from an air line 913 through a pressure regulator 902. The pressurized DI water flows through a DI water supply line 916 to heat exchanger 905, where it is heated or cooled by temperature controlled liquid from chiller/heater 901. The pressurized DI water then flows through a TCU DI water supply line 919 to a TCU DI water inlet 922, which leads into cavity 928.

The DI water fills cavity 928 and provides a substantially uniform fluid pressure against polishing belt 201. The pressure of DI water in cavity 928 is measured by a pressure sensor 923 contained in TCU 906. Pressure sensor 923 provides a feedback signal that controls air pressure regulator 902 to maintain a predetermined pressure, according to polishing requirements. Cavity seal 907 is configured to provide a controlled leakage rate of DI water out of cavity 928 into a collection system (not shown), as indicated by reference numeral 930. DI water is replenished into DI water tank 904 from a facility DI water supply line 912 through an on/off liquid valve 903. Valve 903 is actuated in response to signals generated by liquid level sensors 914 and 915. Process pressures, e.g. cavity pressure and air cylinder pressures (not shown), are adjusted to control DI water consumption.

Convective fluid heat transfer is combined with sealed fluid cavity center support 900 through a closed loop and an open loop cooling and/or heating configuration. The closed loop is designed to have large heating/cooling capacity without contaminating the polishing process. The closed loop is provided by the recirculating temperature controlled fluid between chiller/heater 901 and TCU 906. Recirculating fluid in the closed loop maintains TCU 906 at a predetermined temperature. The open loop is designed to provide efficient final heat transfer between TCU 906 and polishing belt 201 by direct DI water convection through cavity 928. To facilitate the heat transfer process, the DI water is preheated and/or precooled by recirculating temperature controlled fluid in heat exchanger 905 prior to entering cavity 928 through TCU DI water inlet 922. A temperature sensor 921 contained in TCU 906 measures the temperature of DI water in cavity 928. Temperature sensor 921 provides a feedback signal that controls chiller/heater 901 to maintain a predetermined temperature, according to polishing requirements.

Although the configuration described in connection with FIG. 9 involves a single cavity and a single controlled temperature source, the principles are applicable to multiple cavities and multiple selective controlled temperatures, as described above in connection with FIG. 6*a*. Additionally, partitions or baffles can be included in a single cavity to define regions connected to multiple non-uniform controlled temperature sources, in order to provide non-uniform temperature distributions.

Referring to FIG. 6*b*, a pulley 630 engages polishing belt 201 or polishing pad 208 with rolling contact. Heat is transferred longitudinally from pulley 630 into polishing belt 201 or polishing pad 208. To provide a non-uniform lateral temperature distribution, pulley 630 is partitioned laterally into individual segments which are thermally insulated from one another, for example segments 632, 634, and 636. Each segment of pulley 630 is individually heated or cooled, for example using internal resistive heaters 638, 640, and 642. Electric current is provided individually to resistive heaters 638, 640, 642 through rotary contacts 644. The apparatus of FIG. 6*b* provides a non-uniform lateral temperature distribution across polishing belt 201. The lateral temperature distribution can be modified by adding or subtracting individual pulley segments. Alternatively the lateral temperature distribution can be modified by applying selective heating or cooling temperatures to the various pulley segments. Pulley 630 can be either a drive pulley 202, 203 (see FIGS. 2*a*, 2*b*) or a dedicated heat transfer pulley. Segments 632, 634, and 636 of pulley 630 can alternatively be cooled by circulating chilled water or other liquid selectively through internal channels connected through rotary fluid feedthroughs, or by selective thermoelectric cooling.

Heat transfer by solid conduction can also be performed by using a contact plate (not shown) in sliding contact with the surface of polishing belt 201. The contact plate contains individually temperature controlled lateral segments, which transfer their respective temperatures to the sliding polishing belt. The contact plate advantageously provides more efficient heat transfer to polishing belt 201 than does heat transfer pulley 630. However, the friction at the contact plate-belt interface generates heat, surface wear, and mechanical vibration, and increases the required belt drive energy.

Incorporation of conductive heat transfer into polishing head 205 has been described above (see FIGS. 2*a* and 2*b*). Difficulties are encountered because of the relatively large thermal mass of the polishing head, because of the complexities of rotary fluid feedthroughs needed to provide temperature control, and because of unwanted side effects on the wafer and the polishing process. Despite the complexities, conductive heat transfer through the polishing head can be used for process temperature control. In one embodiment, polishing head 205 is partitioned into individual thermally insulated segments (not shown). The segments can be any desired shape, e.g. annuli or sectors, and each can be individually temperature controlled. This approach provides the capability to establish a selective temperature gradient across the wafer surface, thereby enabling local CMP polishing rate control.

Conductive heat transfer can similarly be incorporated into a solid center support 206, without encountering the complexities of rotary fluid feedthroughs. As with polishing head 205, segmentation of center support 206 can provide a selective non-uniform lateral temperature distribution across polishing belt 201. Particularly, the resulting lateral temperature distribution can be aligned accurately with the position of wafer 207 on the opposite side of polishing belt 201.

Linear pad conditioning mechanisms are described in Wilson et al., U.S. patent application Ser. No. 08/965,067, filed Nov. 5, 1997, the specification of which is incorporated herein by reference in its entirety and which is assigned to Aplex, Inc., the Assignee of the present patent application. Conditioners and back supports are described in Wilson et al., U.S. patent application Ser. No. [Attorney Docket M-5677], cofiled herewith, the specification of which is incorporated herein by reference in its entirety and which is assigned to Aplex, Inc., the Assignee of the present patent application. Conductive heat transfer can be incorporated advantageously into conditioner 204 and/or conditioner back support 217 (see FIGS. 2*a* and 2*b*). Laterally segmented implementations of conditioner 204 and conditioner back support 217 can provide selective non-uniform lateral temperature distributions across polishing belt 201. Heat transfer from conditioner 204 or conditioner back support 217 is independent of detailed polisher design and unlikely to cause unwanted side effects, since both are located distant from polishing head 205 and wafer 207.

Referring to FIG. 6*c,* radiant heat (represented by arrows in FIG. 6*c*) is focused onto polishing belt 201 or polishing pad 208 from radiant heating elements, e.g. elements 660, 662, and 664, using respective heat reflectors 666, 668, and 670. Typically elements 660, 662, and 664 are conventional resistive radiant heating elements that generate primarily infrared radiation. Radiant heat from elements 660, 662, and 664 is absorbed by polishing belt 201 or polishing pad 208 at the location where it is focused. To provide a non-uniform lateral temperature distribution across polishing belt 201 or polishing pad 208, the electric currents through elements 660, 662, and 664 are individually regulated.

Described in connection with the above embodiments is an apparatus and method to regulate the temperature to stabilize a CMP process. As described in connection with the above embodiments, heat transfer apparatus and methods provide constant, repeatable temperature regulation and control in a linear polishing process. This temperature regulation and control enables stable removal rates and stable uniformity of results. The approaches described provide flexibility for all process types, including temperatures above and below ambient temperature. In some embodiments, a selective non-uniform lateral temperature distribution is provided across the polishing pad and/or belt. This selective temperature distribution allows adjustable local uniformity and/or removal rate based on the temperature distribution.

Automated temperature control is provided by feedback signals from temperature sensors and/or process monitoring sensors. Process automation and temperature optimization can provide enhanced removal rates. Rapid temperature response is provided by the lower thermal mass of a linear polishing belt relative to a planetary polishing platen. Temperature control equipment and processes are thermally isolated from surrounding machinery. The described benefits are achievable without incurring excessive cost, complexity, or detrimental side effects such as thermal stresses.

While embodiments of the present invention have been shown and described, changes and modifications to these illustrative embodiments can be made without departing from the present invention in its broader aspects. Thus it should be evident that there are other embodiments of this invention which, while not expressly described above, are within the scope of the present invention. Therefore, it will be understood that the appended claims necessarily encompass all such changes and modifications as fall within the described invention's true scope; and further that this scope is not limited merely to the illustrative embodiments presented to demonstrate that scope.

We claim:

1. A belt polishing apparatus, comprising:

a continuous belt of compliant polishing material disposed to travel in a first direction; and a heat transfer source configured to transfer heat between said belt and said source, such that a specified temperature distribution is maintained across said belt in a second direction different from said first direction.

2. The apparatus of claim 1, further comprising a temperature sensor, said sensor being configured to measure said temperature distribution and to generate a signal in response to said measurement.

3. The apparatus of claim 2, including a control mechanism configured to receive said signal and to control said source in response to said signal.

4. The apparatus of claim 3, wherein said heat transfer source includes a plurality of selectively controllable individual heat transfer sources.

5. The apparatus of claim 4, wherein an individual heat transfer source has a temperature differing from the temperature of a different individual heat transfer source.

6. The apparatus of claim 1, wherein said heat transfer source has a temperature above a user specified temperature.

7. The apparatus of claim 1, wherein said heat transfer source has a temperature below a user specified temperature.

8. The apparatus of claim 1, wherein said heat transfer source comprises a fluid.

9. The apparatus of claim 8, wherein said heat transfer source comprises a slurry dispenser.

10. The apparatus of claim 8, wherein said heat transfer source comprises a fluid nozzle.

11. The apparatus of claim 8, wherein said heat transfer source comprises a sealed fluid cavity support incorporating a portion of a surface of said belt.

12. The apparatus of claim 11, wherein said sealed fluid cavity support includes a cavity seal.

13. The apparatus of claim 12, wherein said cavity seal is a labyrinth seal.

14. The apparatus of claim 1, wherein said heat transfer source comprises a pulley.

15. The apparatus of claim 1, wherein said heat transfer source comprises a polishing pad conditioner.

16. A method of providing a specified temperature distribution in a moving continuous belt, comprising:

controlling a heat transfer source disposed proximate to a surface of said belt; and transferring heat between said belt and said heat transfer source in response to said controlling.

17. The method of claim 16, further comprising measuring said temperature distribution and generating a signal in response to said measurement.

18. The method of claim 17, further comprising providing said signal to a control mechanism and controlling said source in response to said signal.

19. The method of claim 18, wherein said heat transfer source includes a plurality of selectively controllable individual heat transfer sources.

20. The method of claim 19, wherein an individual heat transfer source has a temperature differing from the temperature of a different individual heat transfer source.

21. The method of claim 16, wherein said heat transfer source has a temperature above a user specified temperature.

22. The method of claim 16, wherein said heat transfer source has a temperature below a user specified temperature.

23. The method of claim 16, wherein said heat transfer source comprises a fluid.

24. The method of claim 23, wherein said heat transfer source comprises a slurry dispenser.

25. The method of claim 23, wherein said heat transfer source comprises a fluid nozzle.

26. The method of claim 23, wherein said heat transfer source comprises a sealed fluid cavity support incorporating a portion of a surface of said belt.

27. The method of claim 26, wherein said sealed fluid cavity support includes a cavity seal.

28. The method of claim 27, wherein said cavity seal is a labyrinth seal.

29. The method of claim 16, wherein said heat transfer source comprises a pulley.

30. The method of claim 16, wherein said heat transfer source comprises a polishing pad conditioner.

31. A method of controlling the rate of polishing an object in a belt polishing apparatus including a moving continuous belt of compliant polishing material, comprising:

controlling a heat transfer source disposed proximate to a surface of said belt; and transferring heat between said belt and said heat transfer source in response to said controlling, such that said heat transfer source provides a specified lateral temperature distribution across said belt.

32. The method of claim 31, wherein:

said heat transfer source includes a plurality of selectively controllable individual heat transfer sources; and said specified lateral temperature distribution is a non-uniform temperature distribution.

* * * * *